US010777898B2

(12) United States Patent
Palreddy

(10) Patent No.: US 10,777,898 B2
(45) Date of Patent: Sep. 15, 2020

(54) DUAL POLARIZED DUAL BAND FULL DUPLEX CAPABLE HORN FEED ANTENNA

(71) Applicant: ANTENNA RESEARCH ASSOCIATES, Beltsville, MD (US)

(72) Inventor: Sandeep Palreddy, Springfield, MA (US)

(73) Assignee: ANTENNA RESEARCH ASSOCIATES, Beltsville, MD (US)

( * ) Notice: Subject to any disclaimer, the term of this patent is extended or adjusted under 35 U.S.C. 154(b) by 69 days.

(21) Appl. No.: 15/261,971

(22) Filed: Sep. 11, 2016

(65) Prior Publication Data

US 2017/0207541 A1 Jul. 20, 2017

Related U.S. Application Data

(60) Provisional application No. 62/217,341, filed on Sep. 11, 2015.

(51) Int. Cl.

| | |
|---|---|
| ***H01Q 13/00*** | (2006.01) |
| ***H01Q 13/02*** | (2006.01) |
| ***H01Q 1/52*** | (2006.01) |
| ***H01Q 5/55*** | (2015.01) |
| ***H01Q 5/47*** | (2015.01) |

(52) U.S. Cl.

CPC ..... *H01Q 13/02* (2013.01); *H01Q 1/525* (2013.01); *H01Q 5/47* (2015.01); *H01Q 5/55* (2015.01)

(58) Field of Classification Search

CPC ..... H01Q 13/02; H01Q 5/30; H01Q 21/22; H01Q 5/47; H01Q 5/55; H01Q 1/525

See application file for complete search history.

(56) References Cited

U.S. PATENT DOCUMENTS

| | | | | |
|---|---|---|---|---|
| 6,720,932 | B1 * | 4/2004 | Flynn | H01P 1/213 333/21 A |
| 7,289,062 | B2 | 10/2007 | Hudson et al. | |
| 7,659,861 | B2 | 2/2010 | Jan | |
| 7,671,703 | B1 | 3/2010 | Vezmar | |
| 2002/0175875 | A1 * | 11/2002 | Verstraeten | H01P 1/161 343/786 |

(Continued)

*Primary Examiner* — Dieu Hien T Duong

(74) *Attorney, Agent, or Firm* — Sughrue Mion, PLLC

(57) ABSTRACT

A dual band horn feed antenna system having a single combined antenna having a plurality of sub apertures in a collocated environment. The sub apertures are individually coupled to a Tx/Rx and dual polarized capable high band circular waveguide realizing a two band realization with separate Tx and Rx channels. The OMT is realized by a plurality of phase and amplitude balanced signals oriented in such a way as to create balanced & symmetric E and H fields within the coaxial guide. A radiating structure is provided to minimize cross coupling of individual bands. An OMT integrated with a coaxial waveguide base structure where the frequency ratio of the center to outer waveguide structures is within the range on excess of 3:1 or more and thereby enabling adjacent frequency band maximized operation. Adjacent frequency bands will typically require center conductor tubes in a coaxial arrangement to be about 2:1 and certainly less than 3:1 in many cases. Integrated filters on Tx and Rx ports are provided to maximize isolation. A mechanical interface structure allowing the physical freedom necessary for polarization match to incoming signals of arbitrary angle.

4 Claims, 13 Drawing Sheets

(56) References Cited

U.S. PATENT DOCUMENTS

| | | | | |
|---|---|---|---|---|
| 2003/0222733 | A1* | 12/2003 | Ergene | H01Q 13/0208 333/125 |
| 2010/0088729 | A1 | 4/2010 | Lotfy | |
| 2012/0169557 | A1* | 7/2012 | Naym | H01Q 25/04 343/756 |
| 2012/0306592 | A1* | 12/2012 | Mahon | H01P 1/161 333/137 |
| 2015/0097747 | A1* | 4/2015 | Hwang | H01P 1/161 343/785 |

* cited by examiner

DUAL POLARIZED DUAL BAND FULL DUPLEX CAPABLE HORN FEED ANTENNA

This application claims priority to the U.S. Provisional Patent Application No. 62/217,341 filed on Sep. 11, 2015, the disclosure of which is incorporated by reference herein.

BACKGROUND

Field of Invention

The invention encompasses a dual frequency band feed assembly each further subdivided into dual frequency channels for transmitting and receiving. Each Transmit (Tx) and Receive (Rx) channel provides for orthogonally polarized signals coexisting in the same structure eliminating manual feed adjustment. Increased (in excess of 7 dB) Tx/Rx isolation between bands and higher cross polarization (in excess of 5 dB) over current embodiments is achieved using novel techniques.

Description of Related Art

A feed horn assembly typically has a radiating structure, an Orthomode Transducer (OMT) and excitation networks. An OMT combines independent orthogonal waveguide modes into a single guide in order to develop dual independent channels such as a Tx and Rx duplexed system. Some configurations also include filters Low Noise Amplifiers (LNA) and downconverters. An OMT provides access to two orthogonal ports/channels for the lower frequency band such that both modes (Tx and Rx) exist simultaneously inside the guide. Filters, LNAs and downconverters can then be placed inline for coupling to a transceiver. The entire network is typically coupled to a reflector to achieve higher gain (10 to 50 dB improvement), smaller beamwidth (60° to a few degrees or less) performance. Other dual band dual polarized features lack in the performance in several aspects. For instance, due to the general antenna collocation geometry, Tx/Rx isolation and cross polarization performance are insufficient for many applications such as satellite communications. Our disclosure incorporates a mechanical and electrical interface, whereas the entire assembly is easily rotatable realizing polarization matching adjustment for maximum signal throughput. The ratio of the frequencies from high to low band is larger. For instance, there are somewhat similar realizations for X/Ka band but this allows a larger coaxial waveguide (greater than 1.5:1 coaxial diameter ratio) making the Ka application far more trivial due to lower center tube blocking. This is significant/unique to our disclosure and enables port return loss performance which creates isolation and cross polarization performance required by many applications such as Ku/Ka SATCOM. Low band frequencies can be accommodated across the entire Ku band and more but for this type of application they range between 10.9 and 14.5 GHz. Similarly for Ka, frequencies range from 19.0 to 31.5 GHz. Port matching return loss in excess of 10 dB are achieved.

U.S. Pat. No. 7,659,861 has a structure having a Ka (high band) and Ku (low band) comprising a single structure and enabling its use as a dual band feed network for a reflector. The geometry of this patent does not minimize the "obstruction" of the coaxially located Ka waveguide. This results in configurations which could potentially be overmoded in the outer waveguide or yield designs which are incompatible with properly functioning balanced feed networks. These embodiments suffer from low (less than 10 dB) coaxial injection port return loss performance. The resulting structure is more difficult to match and exhibits higher cross polarization which lowers signal levels and reduces Tx/Rx signal purity respectively. There is no incorporated mechanical feature for easily matching the received polarization at skewed angles.

U.S. Pat. No. 7,671,703 has a structure implementing a coaxial OMT operating at C, Ku and/or Ka bands. Specific Ku/Ka band implementation is not delineated. The configuration does not include balanced waveguide feed networks for optimum cross polarization control. No radiating aperture is coupled to the OMT. There is no means to adjust polarization to match the incoming signal. Tx to Rx band isolation is not mentioned and the embodiment does not include a filter.

SUMMARY OF THE INVENTION

The disclosed embodiments provide a dual frequency band, dual channel, dual polarization horn antenna feed assembly. Both bands comprising the dual frequency band feed are incorporated into a single coaxial embodiment. The lower band includes both a transmit and receive port or channel of simultaneous orthogonal polarization. The higher band exists in a concentric geometry and is capable of handling simultaneous orthogonally polarized signals across two channels within the bandwidth. The higher frequency band consists of a tapered circular waveguide that is dielectrically loaded. The high band frequencies pass through this central tube. By dielectric tapering, matching and loading of the circular guide, the outer diameter of the central tube is minimized allowing for high return loss (more than 10 dB) of the OMT input ports over the entire frequency range of the lower band antenna. Tapering is achieved with a conical or exponential conical shape transitioning over at least 5 wavelengths at the center guide frequency. The Lower band Tx and Rx ports are coupled to the coaxial waveguide structure using a plurality of waveguides of equal amplitude and a balanced phasing condition. The coaxial waveguide is connected to a scalar feed plate and higher band circular open ended waveguide for radiation purposes. Both waveguide structures which comprise the antenna are operated in the lowest available waveguide mode. In the case of the high band circular guide, this is the transverse electric (TE11) mode and the guide can support two instances of this mode in and orthogonal configuration. In the coaxial waveguide, the hybrid (HE11) mode is excited and since this provides the base for the OMT it also supports two independent HE11 modes simultaneously. The dielectric loading inside the circular guide is transformed using appropriate geometry into a matching (from the TE11 dominant mode to free space) and beam collimating device so as to minimize cross coupling to the higher band. Inside the coaxial waveguide a plurality of structures are added to launch the correct travelling HE11 mode wave and suppress spurious generation of higher order modes within the cavity. The Tx port structures are included in such a way as to have minimal impact on the Rx channel (isolation of more than 40 dB) by confining their position and geometry to the H-plane field maximum direction. Integrated filter assemblies are incorporated directly to maximize Tx to Rx isolation and eliminating the need in the RF processing unit. The entire assembly can be mounted with the RF processing unit and rotated to minimize polarization loss. The geometry and mechanical structure are designed to be easily integratable to a motorized polarization adjustment device.

DETAILED DESCRIPTION OF THE INVENTION

The disclosure provides a single combined antenna having more than one antenna. The single combined antenna has a plurality of sub apertures in the same physical location or collocated environment.

The sub apertures are individually coupled to a transmitting and receiving dual polarized capable high band circular waveguide (low band) and also a two channel (high band) with separate Tx and Rx channel capability. An OMT is realized by injecting a plurality of phase and amplitude balanced signals oriented in such a way as to create balanced & symmetric E and H fields within the coaxial guide. Disclosed embodiments include a radiating structure to minimize cross coupling of individual bands. Disclosed embodiments include an OMT integrated with a coaxial waveguide base structure. The frequency ratio of the center to outer waveguide structures is within the range on excess of 3:1 or more and thereby enables adjacent frequency band maximized operation. In some prior referenced embodiments, adjacent frequency bands have center conductor tubes in a coaxial arrangement of about 2:1 to about 3:1. In some embodiments, the frequency at which the two bands can operate needs a separation of less than about 1.5:1 for Frequency high to Frequency low. Frequency high is the lower bound of the upper frequency band and Frequency low is the upper bound of the lower frequency band. This is a significant improvement over other references and allows far greater frequency combinations and many variants of common requirements such as Ku and Ka bands utilized in satellite communications. Previous solutions either must separate frequencies to a greater degree (2:1, 3:1 or more) or suffer deleterious effects in performance undesirable for their application. Some embodiments provide integrated filters on Tx and Rx ports to maximize isolation. Some embodiments provide a mechanical interface structure allowing the physical freedom necessary for polarization match to incoming signals of arbitrary angle. Some embodiments of the antenna system also include an equal amplitude and balanced feeding arrangement coupled to the coaxial guide enabling (at least 5 dB) significant cross polarization improvement. Some embodiments of the antenna system include a dielectrically loaded and matched central waveguide for carrying high band signals and minimizing coaxial waveguide diameter and allowing launch of the HE11 mode with port return loss in excess of 10 dB when coupled to the outer coaxial guide. Some embodiments of the antenna system include impedance matching and isolation features inside the coaxial guide. Some embodiments of the antenna system include a plurality of symmetric coaxial waveguide excitations by means of waveguide combining or dividing networks located external to the coaxial guide.

Figure 1:
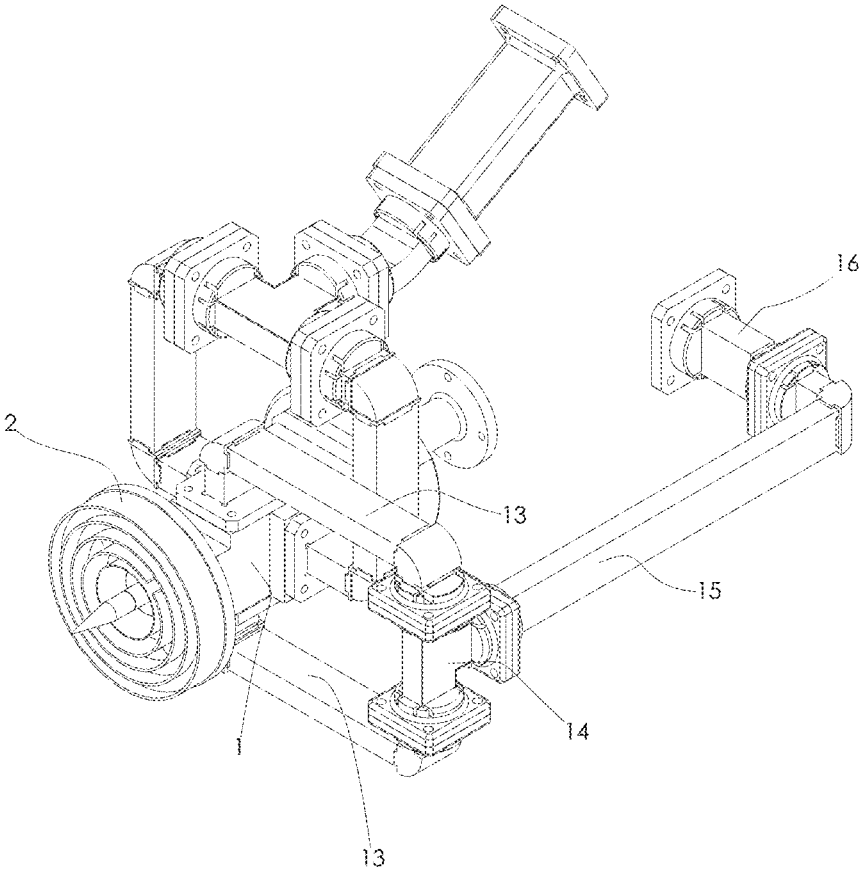
FIG. 1 illustrates an exemplary representation of a dual band dual channel horn feed antenna.

FIG. 1 illustrates an exemplary dual band, dual channel feed assembly for a reflector antenna system according to a first embodiment. This can be used for this system is as a feed horn for a satellite communication system. Such a system would have both commercial and military applications and could exist in a wide range of dual bandwidth combinations chosen from the among the entire microwave spectrum. Disclosed embodiments can include the following characteristics: An antenna with essentially a constant phase center across all bandwidths making it an excellent dual feed antenna. Excellent cross polarization performance in all bands Compatibility with utilization of higher frequency bands to enable greater bandwidth usage and data throughput of the system. Ability to implement adjacent microwave bands with no loss of system performance. Tailored reflector illumination in all bands for maximum efficiency & gain, sidelobe performance and reflector configuration. A mechanical interface to an automatic or manual rotating system enabling better polarization match and higher throughput. Maximum port to port signal isolation.

Figure 2:
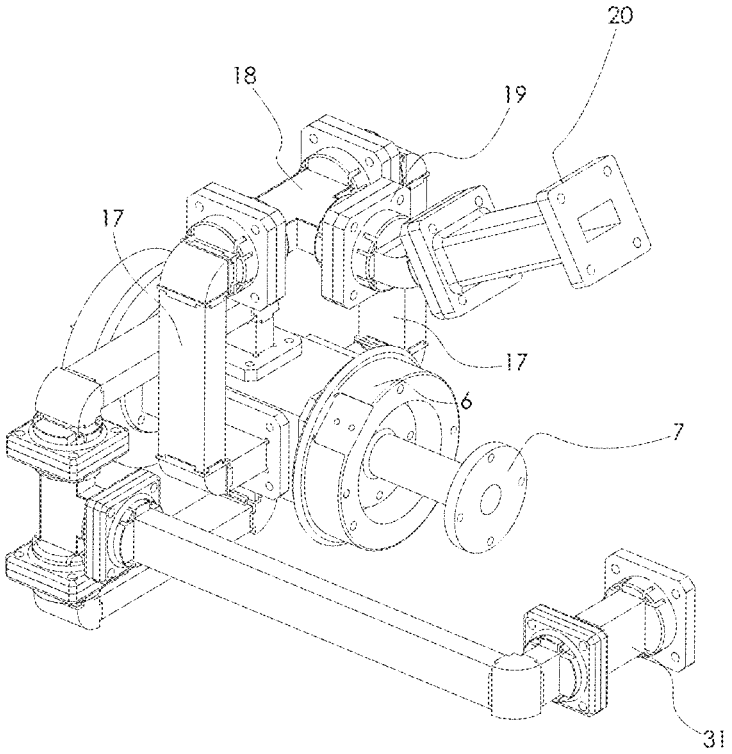
FIG. 2 is a back view of the exemplary representation of the dual band dual channel horn feed.
Figure 3:
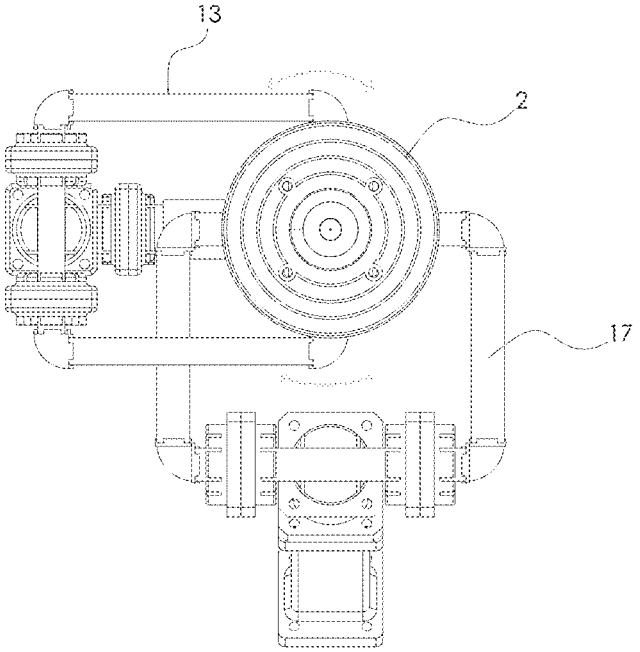
FIG. 3 is an RF feed assembly showing major components.

The feed assembly includes components such as: 1) A radiating scalar feed plate (FIGS. 4 and 5, item 2). 2) A coaxial waveguide OMT (FIG. 1 item 1) 3) Lower band transmit input port (FIG. 1 item 16) 4) Lower band receive output port (FIG. 2, item 20) 5) High band waveguide port (FIGS. 4 and 5 item 7) 6) Waveguide feeding networks (FIGS. 1 and 2 items 13, 14, 15, 17, 18 and 19) and 7) Polarization adjustment interface (FIG. 2 item 6).

The radiating scalar feed plate (FIGS. 4 and 5 item 2) controls the reflector illumination and thereby the reflector efficiency/gain, sidelobes, cross polarization & axial ratio. Through control of the corrugations in the face plate (FIGS. 4 and 5, item 2), E and H plane patterns can be matched maintaining excellent cross polarization and axial ratio performance. This embodiment also controls the length of the feed assembly and allows for optimal reflector illumination resulting in higher efficiency and desirable low sidelobe levels. Since most reflector applications rely on fixed point focal location, it is essential that the phase center of the two bands be coincident and constant over each frequency within the band. Details of the opening (FIG. 4 item 25) of the higher band waveguide and how it coexists with the output of the coaxial waveguide as well as the shape of the dielectric central rod (FIG. 4 item 22) are critical to reflector performance. The dielectric rod (FIG. 4 item 22) enables the higher band to efficiently illuminate the reflector while not interfering with the lower band radiation. The symmetrical nature of the face plate (FIGS. 4 and 5 item 2) preserves the balanced nature of the TEl and HE11 waveguide modes allowing for high cross polarization and low axial ratio. The integrated nature of the radiating structure and the specialized OMT with the higher band propagating waveguide at its core provides for optimization of performance not achievable through use of a building block design. While some other references provide some of the features included here, in many cases they exist as separate building blocks (separate OMT etc.). Without the type of integration accomplished here, performance specifications such as highest cross polarization, efficient reflector illumination or resultant pattern regularity are not achieved. The integration here is not just cobbling parts together but is accomplished in a way such that design aspects are shared amongst components and a type of electromagnetic harmony is created. Other work which is comprehensive in terms of feed components does not exhibit this aspect of integrated design or does not utilize features to such as that included here (ie. Scalar feed plate step/flare features). These features in the higher band center section minimize interaction to the lower band and more independently control reflector illumination than similar existing embodiments.

An orthomode transducer (OMT) (FIG. 1 item 1) manifested in a coaxial waveguide (FIG. 4 item 28) arrangement is realized as a feed mechanism for the radiating structures. The OMT operates on the coaxial waveguide principle and is excited in the dominant HE11 mode. Its construction is such as to suppress higher order modes and maximize cross polarization performance. The center "conductor" (FIG. 4 item 29) of the coaxial waveguide (FIG. 4 item 28) implements the higher band propagating structure through its center. The geometry and diameters are critical to maintaining proper dual channel excitation with minimal cross coupling. This imposes a condition on the higher band central tube (FIG. 4 item 29) that must be mitigated for the entire assembly to function. The OMT (FIG. 1 item 1) is coupled to the scalar feed plate (FIGS. 4 and 5 item 2) via a transition at its output. Excitation of the HE11 mode is accomplished for both the Tx and Rx channels in much the same manner. The input Tx port (FIG. 4 item 9T) can be divided into two or more balanced signals and then presented to the coaxial waveguide via a plurality of apertures along the length of the guide. Typical (existing) embodiments of a similar type are frequently realized more asymmetrically resulting in improper mode excitation and lower cross polarization performance. The key aspect of the disclosed embodiment is in the way the ports access the waveguide (FIG. 4 item 28) while minimizing cross coupling between opposite ports and thereby improving return loss characteristics and reflector pattern control. The key aspect of the described OMT (FIG. 1 item 1) is that it allows the lower and higher bands to be closer together. Ideally it is desirable for the bands to be separated as much as possible to eliminate influence of one on the other in the collocated embodiments. Many embodiments exist that cover dual band operation. Few of them enable performance in adjacent bands such as Ku and Ka. This is significant because the SATCOM industry utilizes Ku frequencies to a great extent and increasingly continues to move into the Ka bands to realize greater channel bandwidth and data throughput (broadband). This OMT (FIG. 1 item 1) not only allows adjacent band operation but maximizes performance in those bands to equal or exceed traditional performance exhibit by traditional combined feeds or even separate antennas. Specifically in other embodiments, improper excitation of the HE11 mode or limited isolation of the feeding network components causes lower cross polarization, poorer axial ratio, lower isolation between Tx and Rx low band channels or poor impedance match. Our disclosed embodiment uses a balanced feed network utilizing aperture controlled waveguide ports along the axial length of the coaxial waveguide. Unbalanced E and H fields inside the coaxial guide manifest into lower cross polarization and higher axial ratio in both the Tx and Rx channels of the lower band. Our disclosed embodiment mitigates this effect through unique launch transitions (FIG. 4 item 30) which direct the fields into the guide while simultaneously remaining "invisible" to the orthogonal modes created within the guide. By controlling the size and shape of the aperture of the waveguide injection ports (FIG. 4 item 9T) (FIG. 5 item 10R), return loss (matching) and port isolation are maximized. A thin iris of less than 1/15 wavelength thickness with an E plane narrowing opening is applied. Rectangular or "dog bone" shaped iris' can be employed to achieve the required returns loss and port to port isolation characteristics. While an OMT provides inherent isolation between Tx and Rx channels, much prior work relies on more substantial filter networks to achieve the ultimate isolation required by the RF processing units. By minimizing the diameter ratio of the coaxial waveguide (FIG. 4 item 28) features through higher band manipulation and changing the shape and size of the Tx and Rx injection ports, our design minimizes the filter requirement reducing complexity and cost in the system. In many applications a single filter (FIG. 4 item 31) is required between Tx and Rx ports thus reducing the complexity by more than half over other designs.

Figure 4:
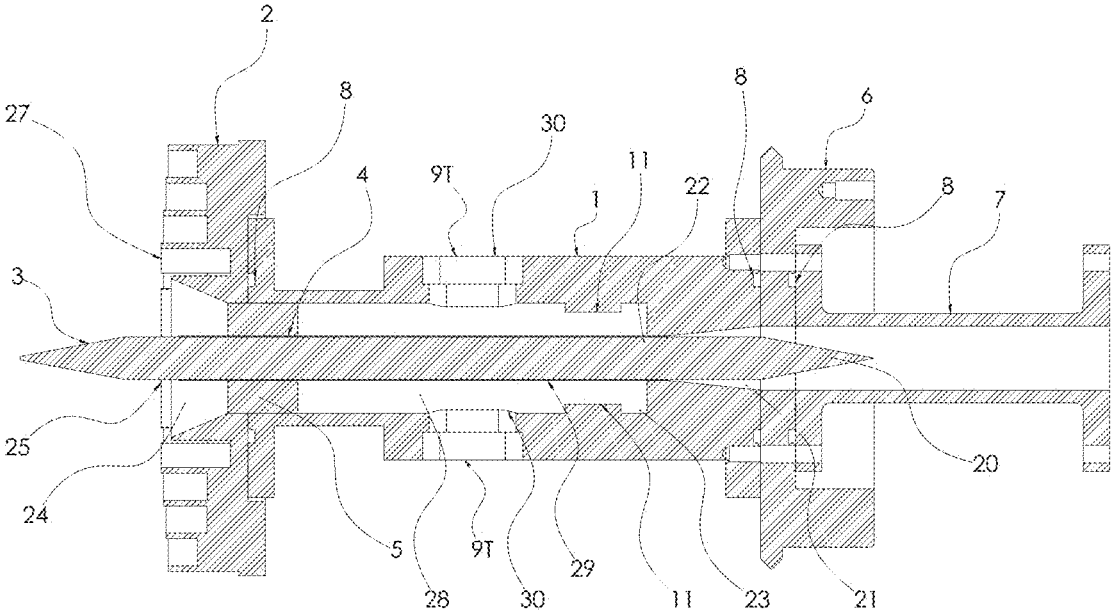
FIG. 4 is a cross sectional view showing detail of the RF collocation mechanism.
Figure 5:
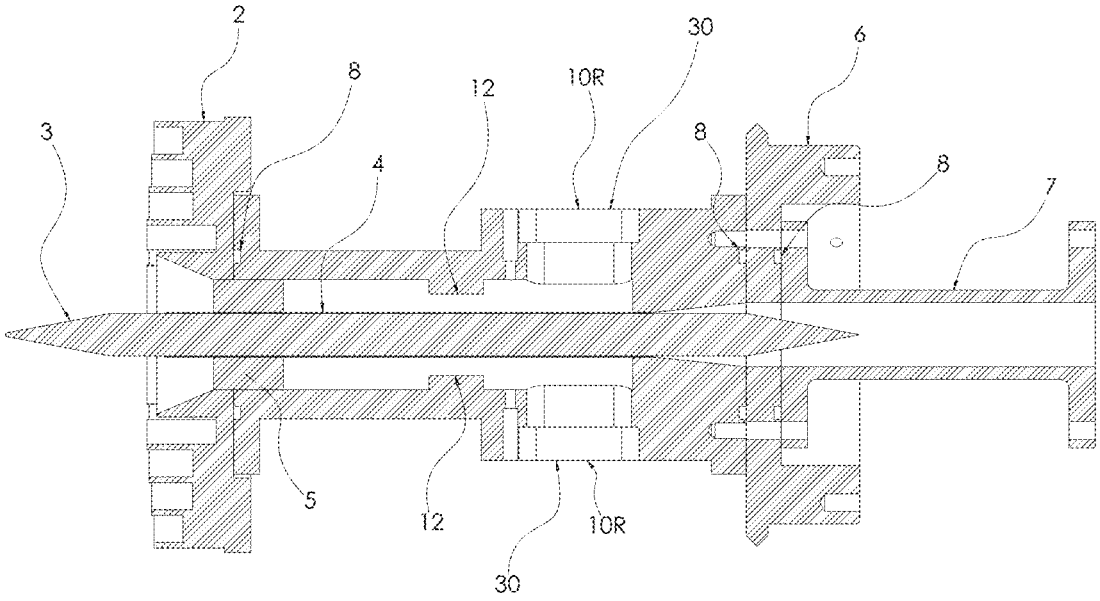
FIG. 5 is an orthogonal cross sectional view showing detail of the RF collocation mechanism.
Figure 6:
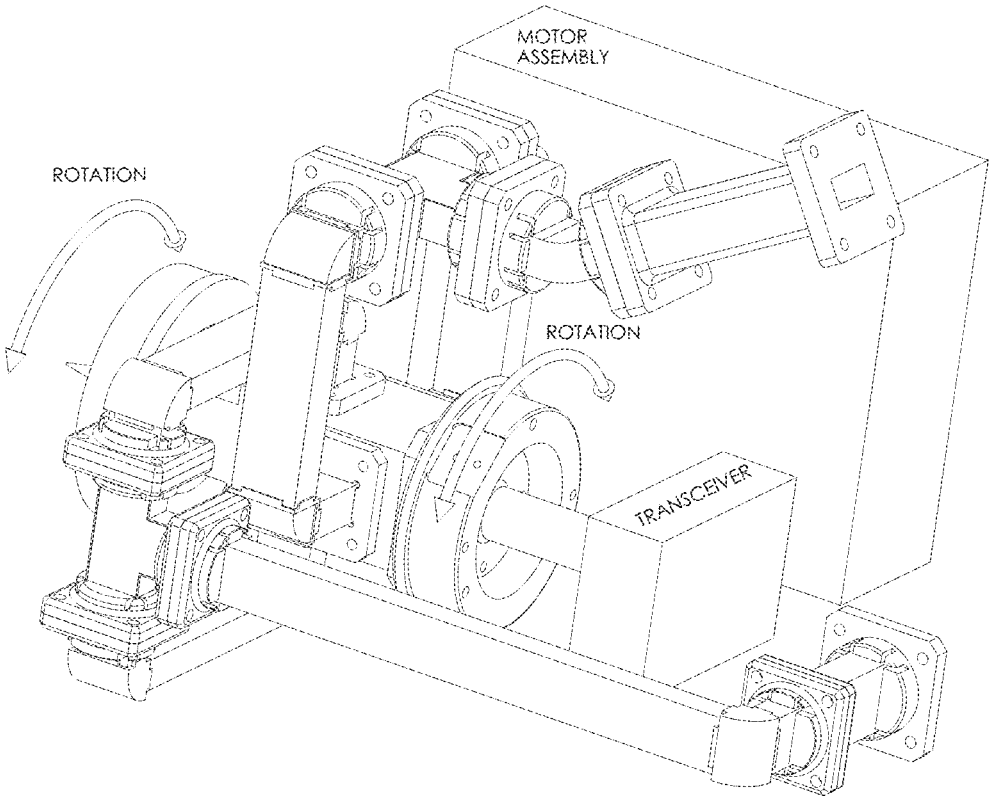
FIG. 6 is an example of a typical configuration with a transceiver and polarization adjustment motor.

The OMT (FIG. 1 item 1) is realized by the use of 10 key components. An outer conductor both serves as the body of the device and the outer diameter of the coaxial waveguide structure. The central tube (FIG. 4 item 29) containing the higher band transmission device serves as the inner conductor of the lower band coaxial waveguide (FIG. 4 item 28). A plurality of injection ports (FIG. 4 item 9T) (FIG. 5 item 10R) are cut into the axial length of the coaxial guide to allow launch of the HE11 balanced modes in orthogonal planes. Each injection port site is coupled to a feeding waveguide by a novel shaped and sized iris (FIGS. 4 and 5 item 30). The Tx port (FIG. 4 item 9T) is routed to a dividing network (FIG. 1 item 14) (FIG. 2 item 18) with a plurality of outputs (FIG. 1 item 13) (FIG. 2 item 17) that correspond to the injection ports created in the coaxial body. The Rx port (FIG. 2 item 20) is handled in the same manner as the Tx (FIG. 1 item 16) port and is realized in appropriately sized waveguide (FIG. 1 item 13 and 15) (FIG. 2 item 17) to carry the desired frequencies. The coaxial guide (FIG. 4 item 28) is shorted (FIG. 4 item 23) at the back of the guide in such a way as to provide minimal standing waves in both the Tx and Rx modes inside the guide. An Rx wave launching device (FIG. 4 item 11) is included directly adjacent to the shorting structure (FIG. 4 item 23) to minimize cross coupling between the plurality of internal Rx ports (FIG. 2 item 10R). Each Tx internal port (FIG. 1 item 9T) is coupled to a plurality of features (1 for each port) inside the coaxial guide which reduces field coupling to distinct Tx internal ports while not disturbing the orthogonal mode. The OMT (FIG. 1 item 1) employs a dielectric spacing (FIGS. 4 and 5 item 4) device to properly align and fix the higher band transmission tube while minimizing impact on the lower band through its size and shape. The OMT (FIG. 1 item 1) further includes as is integrated with a matching radiating section (FIG. 4 item 24) that is also an integral component of the scalar face plate (FIGS. 4 and 5 item 2).

High band—A flanged circular waveguide (FIG. 4 item 28) of matched diameter to the transceiver input section is connected through a small propagating section (FIGS. 4 and 5 item 7). The circular guide (FIG. 4 item 29) internal diameter is changed over approximately ¼ of its length in such a way as to drive the guide into cutoff at 15%-20% above the lower end of the frequency spectrum. The outer diameter of the tube (FIG. 4 item 29) is minimized to be as small a wall diameter as that will support the mechanical disclosed embodiment. The circular guide (FIG. 4 item 29) is shorted at the back end of the coaxial waveguide (FIG. 4 item 28). The circular guide (FIG. 4 item 29) continues along the inside of the coaxial guide at the changed diameter through the length of the OMT (FIG. 1 item 1). The internal waveguide is supported by a dielectric fixation to the coaxial waveguide (FIG. 4 item 28) outer surface. The circular waveguide (FIG. 4 item 29) diameter then increases to better match the waveguide to the radiating aperture and free space. It then takes on a specific shape to match to free space and coexist in the scalar feed plate (FIGS. 4 and 5 item 2) causing a minimum of disturbance to the lower band radiation. Inside the coaxial waveguide (FIG. 4 item 28) there are three distinct sections implemented to accomplish a diversity of functions. The three sections are realized as a single piece of dielectric (FIG. 4 item 22) of dielectric constant in the 2 to 3 range. Realizations could be accomplished in different ways with a variety of dielectric types providing their loss tangent is very low. The first section of dielectric (FIG. 4 item 26) is used as a matching device for dissimilar diameter circular guides enabling continuous existence of the TEl dominant mode while rejecting origination and propagation of higher order modes. The transition (FIG. 4 item 21) from the first section to the second section is such that the shape is matched at the junction. The second section of dielectric (FIG. 4 item 22) acts to lower the cutoff frequency of the TEl mode sufficiently to propagate the lowest frequency in the higher band. The transition (FIGS. 4 and 5 item 3) from the second section to the third section is such that the shape of each section is matched at the junction. The third section of dielectric has two functions. The first being to properly launch the TE11 propagating mode in the circular guide, through the waveguide aperture and into free space. The second function of section 3 (FIGS. 4 and 5 item 3) is to form the beam for proper illumination of the reflector.

RF Transceiver Interface—The disclosed embodiments can be utilized to realize a full dual band satellite communication system with external components. The dual band feed design is adaptable to multiple reflector geometries including prime focus and offset fed arrangements with reflector contours of almost any shape. Through simple adjustment of the scalar face plate (FIGS. 4 and 5 item 2) realization, the radiation characteristics can be adjusted to create a multitude of reflector illumination configurations while maintaining all other performance aspects. Due to the increased inherent Tx/Rx isolation of the disclosed embodiments, a single filter (FIG. 2 item 31) can be included in the receive chain to achieve the required signal separation for proper satellite communications exhibiting improved broadband data performance. The filter would have two major advantages over other designs in that it would be less complex requiring fewer components and also could be lower power handling capable. These two benefits significantly lower filter costs of a typical system by more than half. The entire assembly is arranged to be connected to a transceiver and can easily be rotated via a novel mechanical interface (FIG. 2 item 6) and electrical component configuration unique to this disclosed embodiment. This embodiment minimizes polarization loss using a separate automotorized adjustment mechanism. By taking advantage of the disclosed embodiment's ability to operate in an adjacent dual banded configuration without sacrificing electrical performance, new SATCOM applications can be fully realized. When used in a mobile "News gathering" SATCOM system, the disclosed embodiment characteristics can be particularly exploited. These systems have historically operated in Ku band with limited data throughput performance. Newer embodiments can use the high Ka band which enables significantly higher data bandwidth throughput and redundant satellite resources. Most configurations of this type require physically changing the horn feeds to move from Ku to Ka band and vice versa. This is a slow process and often inconsistent with the needs of the application. Many of these system also have no allowance for continuous polarization adjustment and suffer signal loss. The few alternatives which could implement a dual band structure suffer from one or more deficiencies. Most cannot allow adjacent frequency bands and are limited to such applications as C/Ku which are not as desirable. Even still, those potential configurations which have been suggested for operation in adjacent bands (Ku/Ka) are inferior in one or more of cross polarization performance, efficiency, signal polarization matching or cost of implementation. The disclosed embodiment is also not limited to the construction details indicated here. Lower cost manufacturing techniques can easily be implemented which include: a mechanically homogeneous incorporated waveguide and combiner/divider design and the ability to cast or 3-D print most components due to how they are integrated.

Polarization Adjustment Interface—The disclosed embodiment can be realized such that a mating mechanical interface can easily be added to rotate the entire assembly about the axis of transmission. This feature enables ease of polarization adjustment via either a manual or automatic manipulation mechanism. Traditional polarization matching techniques would typically employ physical disconnection and reconnection of the feed through some purely manual adjustment mechanism if the option to adjust polarization would exist at all. Better polarization match enables higher signal levels across all bands and allows for a wider range of satellite resources availability.

Figure 7:
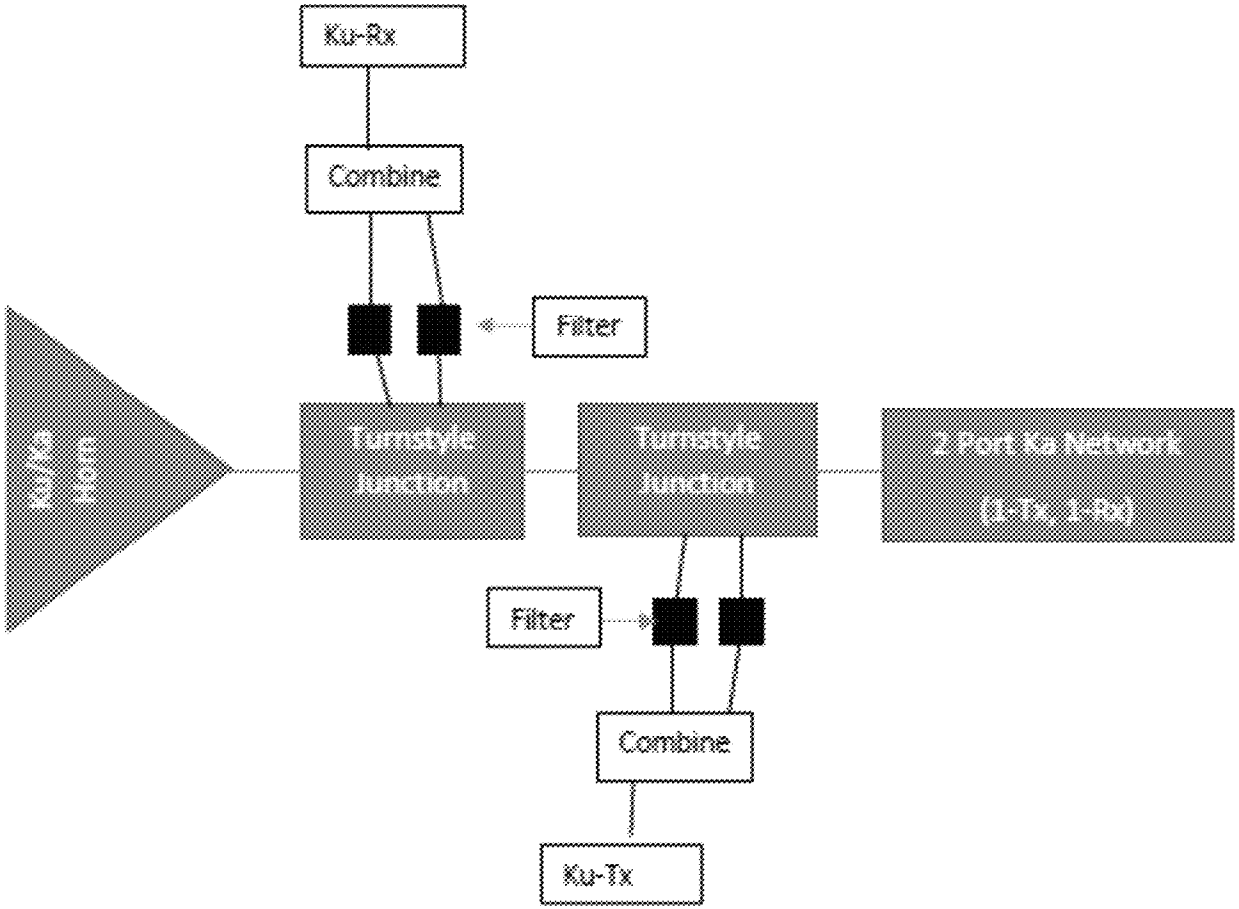
FIG. 7 shows a schematic block diagram of an alternate embodiment according the disclosed teachings.
Figure 8B:
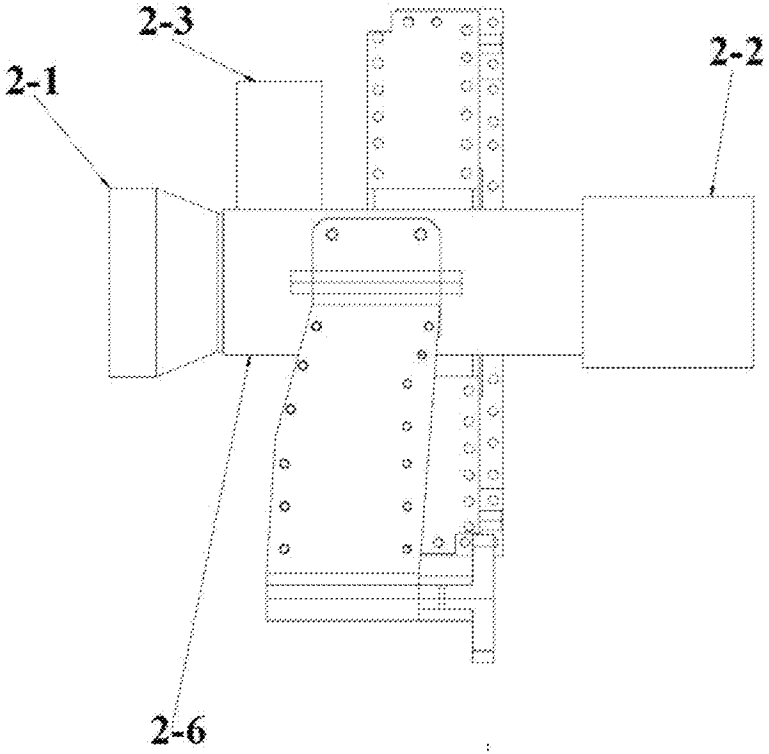
FIGS. 8*a* and 8*b* are exemplary representations of front and top view of an alternate embodiment of the dual band dual channel antenna according to the disclosed teachings.
Figure 8A:
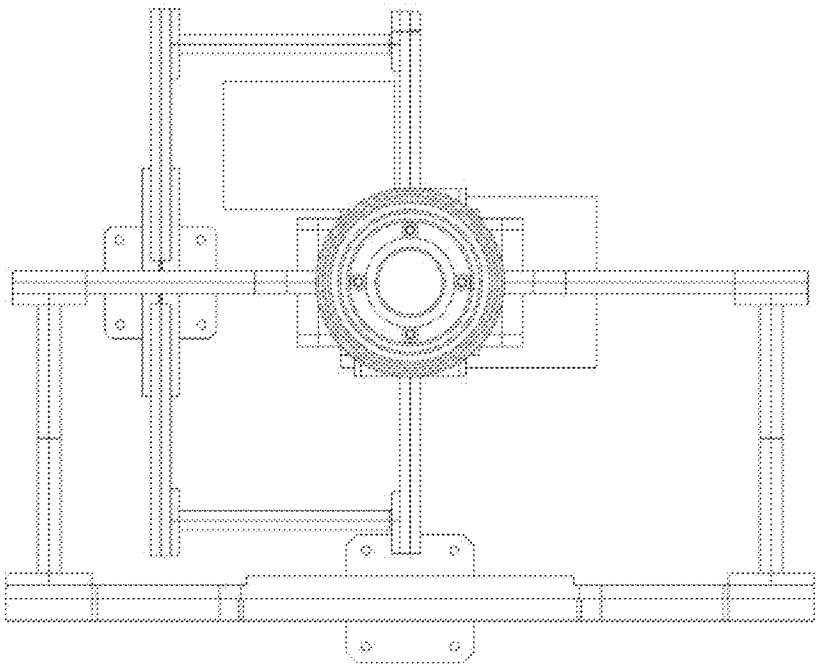
Figure 9:
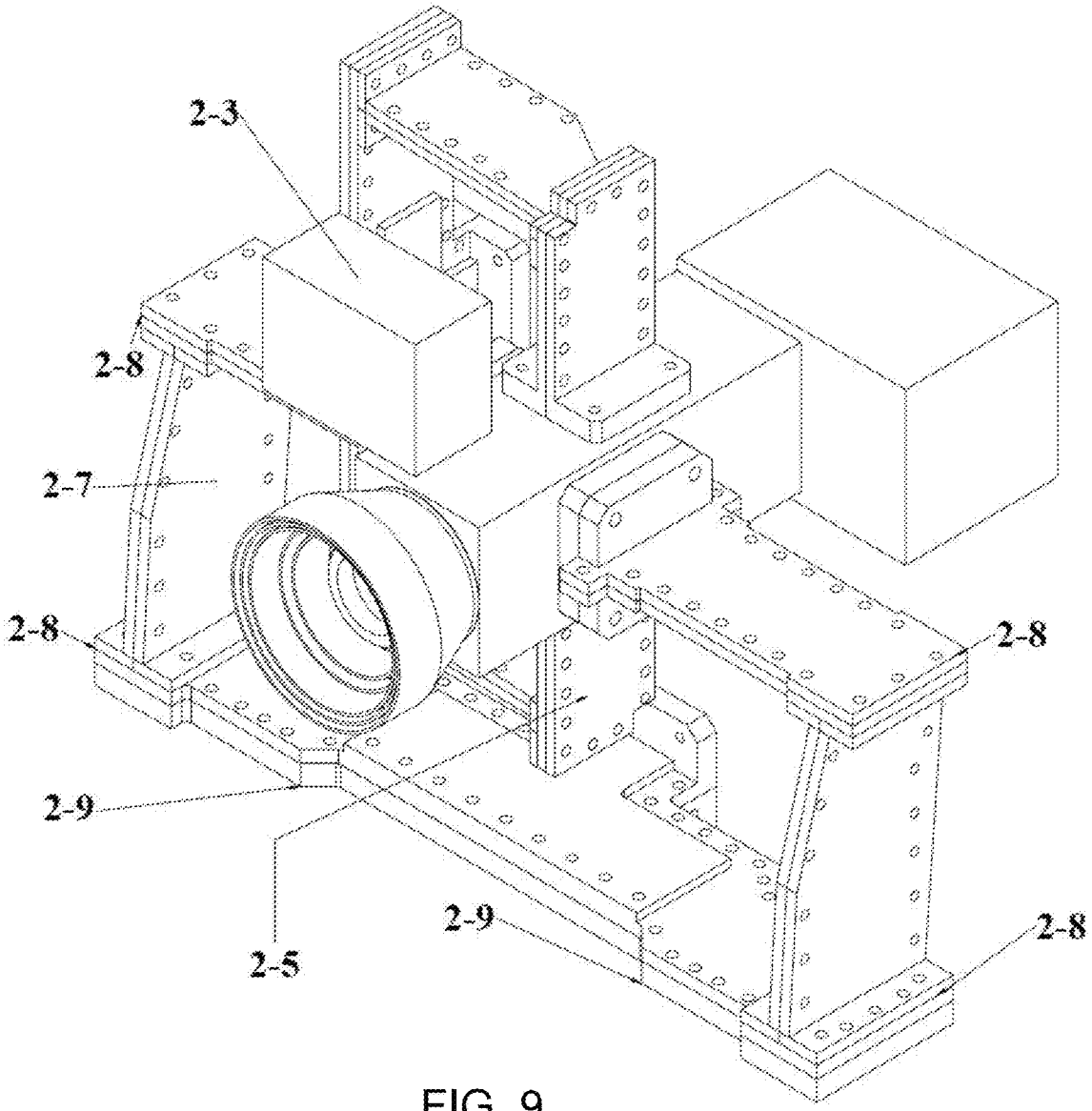
FIG. 9 is a perspective view of the alternate embodiment according to the disclosed teachings.
Figure 10:
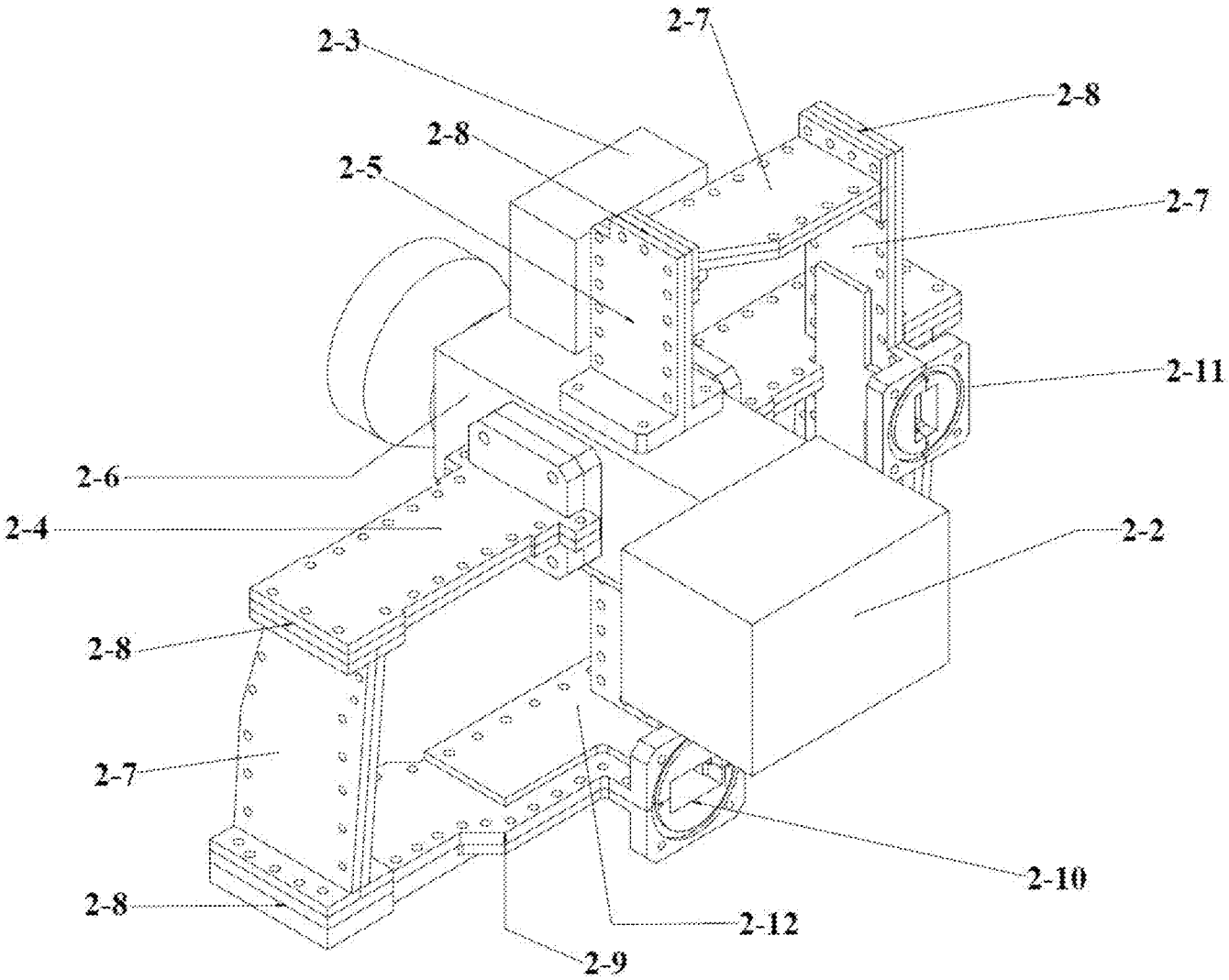
FIG. 10 is a rear perspective view of the alternate embodiment according to the disclosed teachings.
Figure 11:
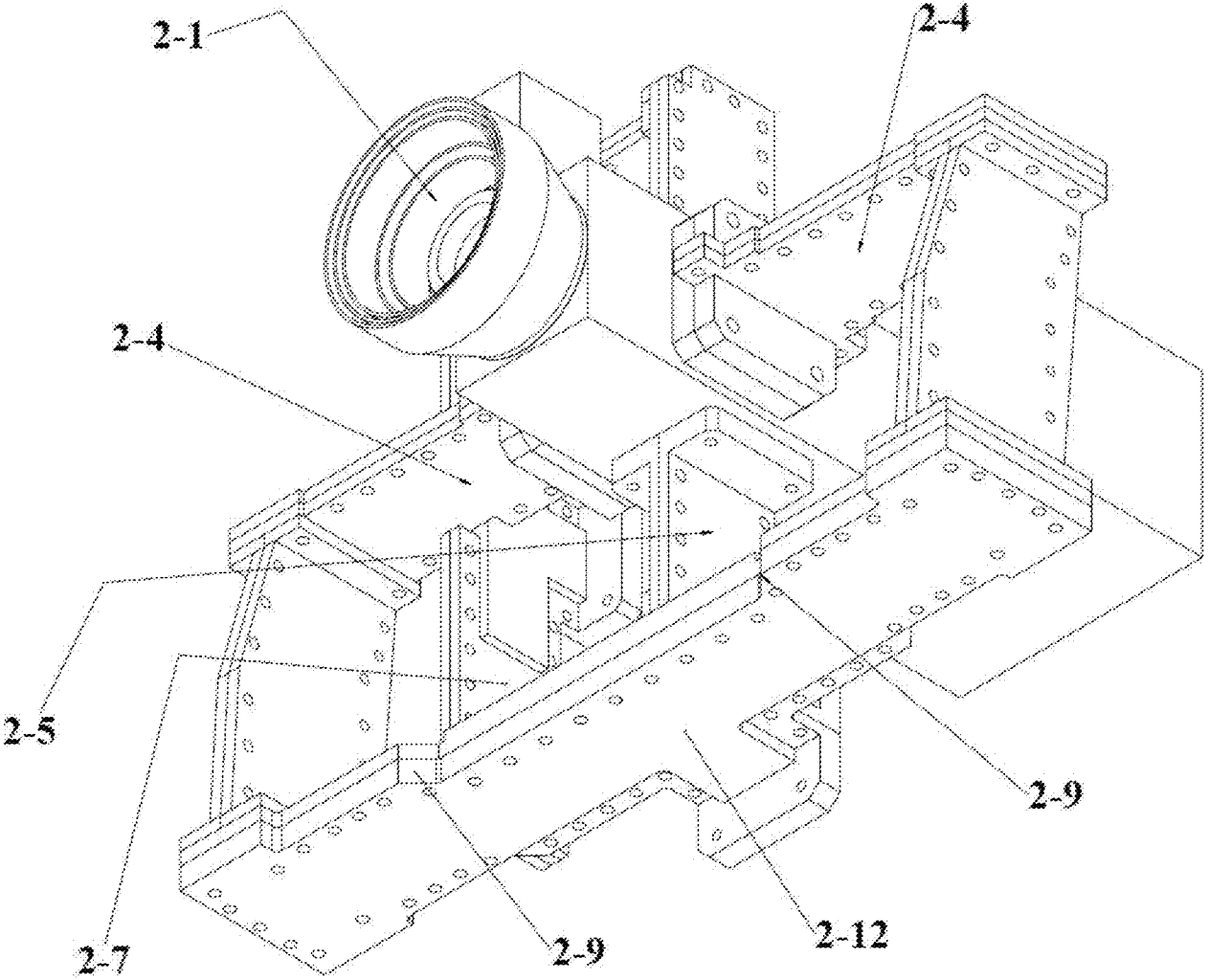
FIG. 11 is a front and bottom perspective view of the alternate embodiment according to the disclosed teachings.
Figure 12:
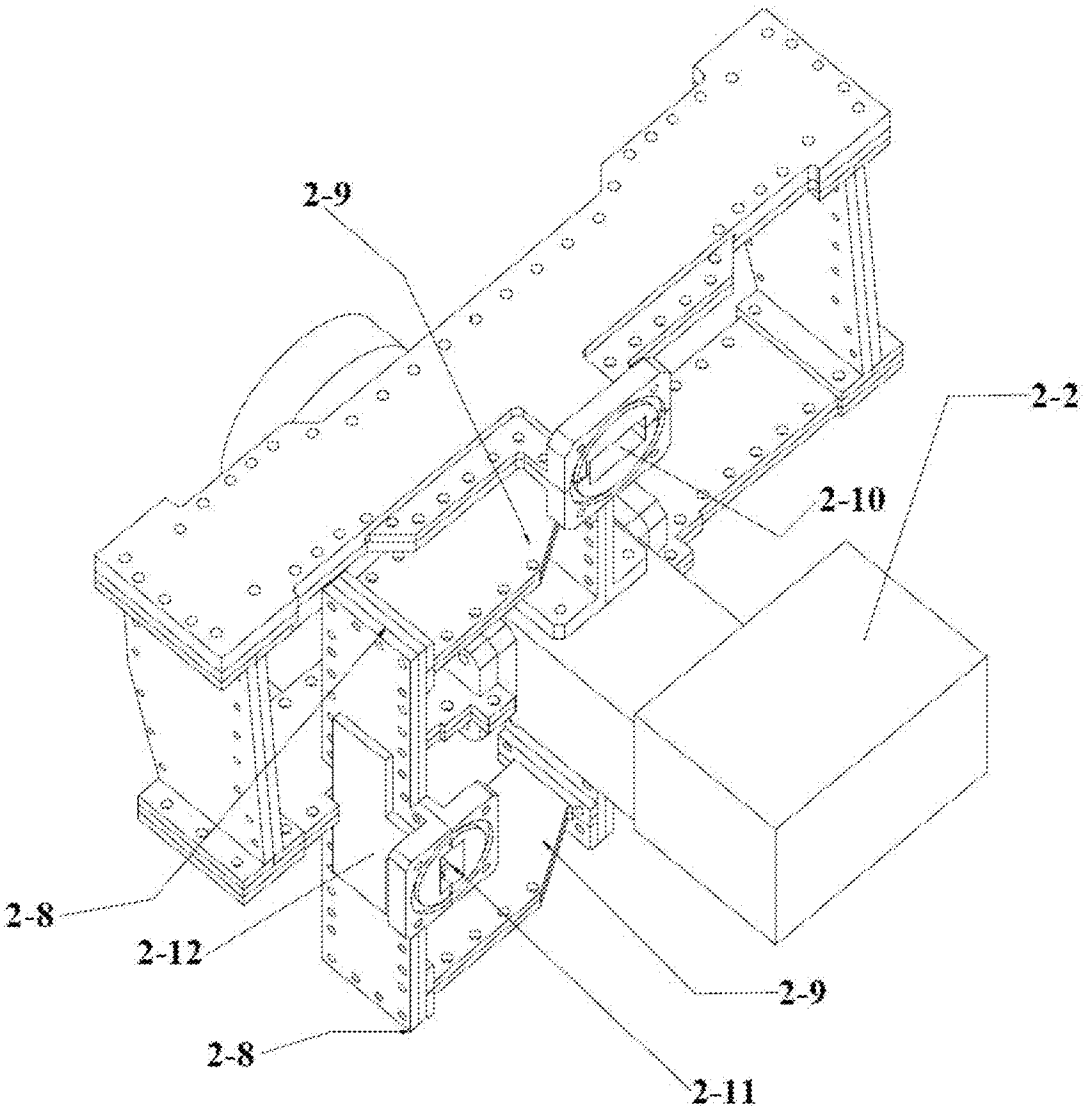
FIG. 12 is a rear and bottom perspective view of the alternate embodiment according to the disclosed teachings.
Figure 13:
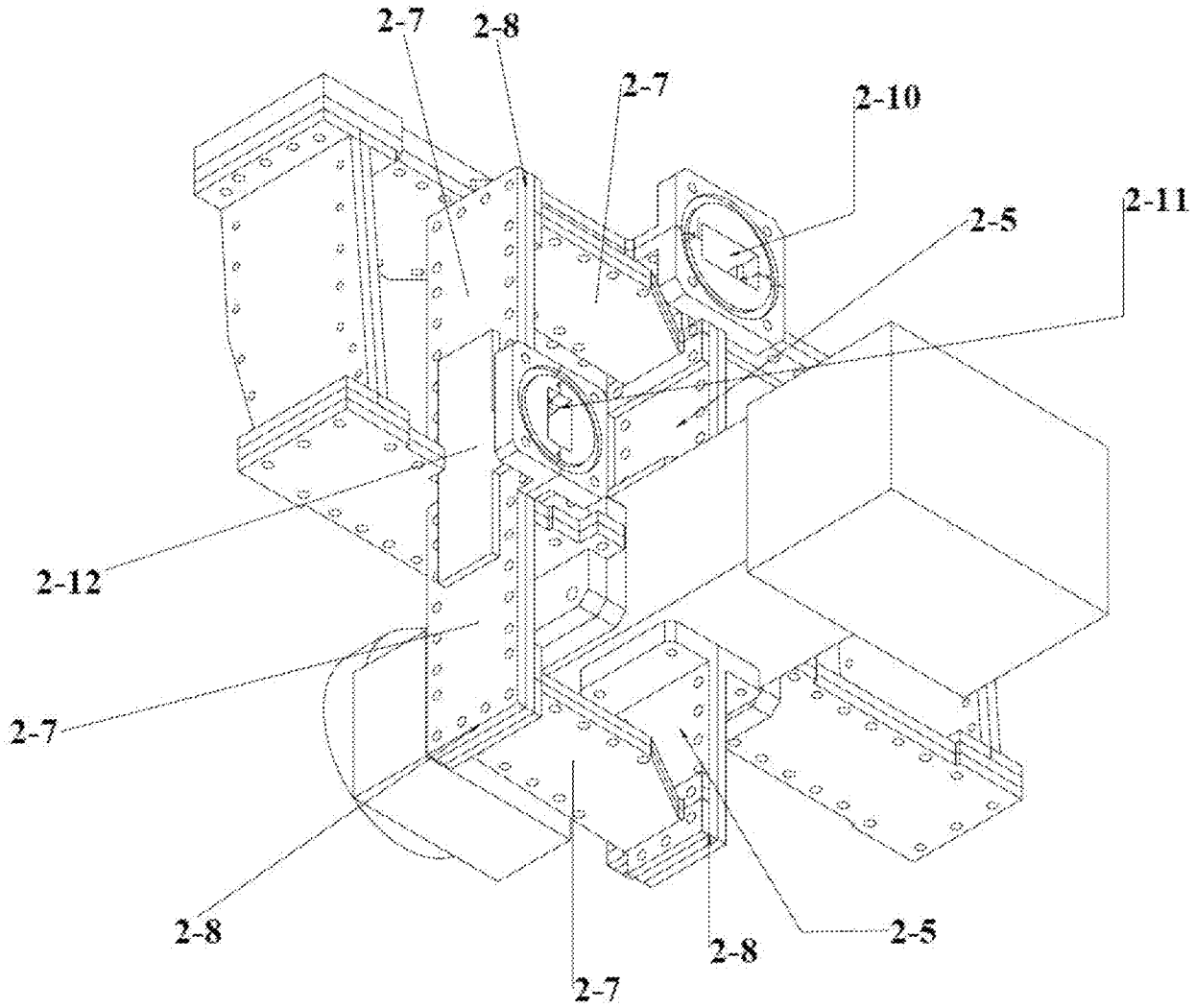
FIG. 13 is another rear perspective view of the alternate embodiment according to the disclosed teachings.

An alternate embodiment of the disclosed teaching are described herein. A schematic block diagram for the alternate embodiment is presented in FIG. 7. In this alternate embodiment, the feed is provided by a multiband horn, which efficiently illuminates reflector in both Ku and Ka Tx and Rx bands. The horn is fed by a common Ku/Ka junction; Ku band is fed by a series of turnstile junctions. Ku band Rx turnstile junction is attached to the horn, while Ku band Tx turnstile junction is behind Ku band Rx junction. Ku band Tx and Rx legs have filters to reject Ka frequencies. The legs are combined using tees to yield linear ports. Ka band network is used behind Ku Tx turnstile junction.

An exemplary implementation of the alternate embodiment is shown in FIGS. 8-13. A Choked Horn Antenna 2-1 is provided. This Choked Horn Antenna operates in both Ku and Ka bands and efficiently illuminates reflector in both Ku and Ka Tx and Rx bands. A Ka transceiver 2-2 is provided. This transceiver 2-2 transmits and receives in Ka band. A polarizer motor 2-3 is provided. This polarizer motor 2-3 rotates the entire feed to align horizontal and vertical linear polarizations in the Ku band. A low pass filter 2-4 Ku Rx is provided. The low pass filter 2-4 Ku Rx lets the Ku band pass through while rejecting the Ka band. Another low pass filter 2-5 Ku Tx is provided which lets the Ku transmit band pass through while rejecting the Ka band. 2-6 is the Turnstile Junction/Ortho Mode Transducer. 2-6 is a common junction for both Ku and Ka bands, with Ku band injected from the 4 side legs and Ka band injected from the through port. This common junction 2-6 attaches to the choked horn antenna.

A waveguide line 2-7 is provided which is a piece of waveguide. An E-plane bend 2-8 is provided that attaches to the waveguide line 2-7. In the E-plane bend 2-8, the electrical field changes direction. An H-plane blend 2-9 is provided that is perpendicular to the E-plane bend 2-7. In the H-plane blend 2-9, the magnetic field changes direction. 2-10 is a Ku-Rx port which is a Ku receive band waveguide port. Similarly, Ku-Tx port 2-11 is a Ku-Tx port that is a Ku transmit band waveguide port. A waveguide T-junction 2-12 is provided that is a 3 port waveguide device that combines two waveguide legs into a common waveguide leg.

Exemplary embodiments were chosen and described in order to explain operations and the practical applications of the disclosed teachings, and to enable a skilled artisan to understand the disclosed teachings with various modifications as are suited to the specific implementation. However, other modifications are possible without deviations from the spirit of the invention and are within the scope of this disclosure. That is, various modifications to these exemplary embodiments will be readily apparent to the skilled artisan, and the general principles and specific examples described herein may be applied to other embodiments without the use of inventive faculty. Therefore, the inventive concept is not intended to be limited to the exemplary embodiments described herein but is to be accorded the widest scope as defined by the limitations of the claims and equivalents thereof.

What is claimed is:

1. A dual band horn feed antenna system, the antenna system being operable in both Ku and Ka bands, the antenna system comprising:

a choked horn, the choked horn comprising Ku chokes and Ka chokes, a non-tracking feed system, the non-tracking feed system further having an Orthomode Transducer (OMT) with coupling slots for simultaneous dual band operation, filter in the Ku band, the filter being integrated into a feed and the filter being next to the OMT, the feed being passive without requiring power input, wherein the feed is a simultaneous Ku and Ka feed, wherein the OMT is a turnstile, wherein polarizations remain fixed in Ku and Ka bands, wherein the feed has a multi-band single radiator.

2. The dual band horn system of claim 1 wherein the coupling slots are provided to couple frequencies into a circular waveguide.

3. The dual band horn system of claim 1 wherein the OMT is a non-ridged waveguide design.

4. The dual band horn system of claim 1 wherein the OMT has at least 4 ports.

* * * * *